US006158831A

United States Patent [19]

Brown et al.

[11] Patent Number: 6,158,831

[45] Date of Patent: Dec. 12, 2000

[54] PREASSEMBLED FOLDABLE OFFICE SUITE

[76] Inventors: Charles R. Brown, 3297 Columbia Rd., Orangeburg, S.C. 29118; Marion O. Fogle, 1073 Zion Church Rd., Orangeburg, S.C. 29115; Thomas F. Salley, 2295 Old Riley St., Orangeburg, S.C. 29118

[21] Appl. No.: 09/268,459

[22] Filed: Mar. 16, 1999

Related U.S. Application Data

[63] Continuation-in-part of application No. 08/885,296, Jun. 27, 1997, Pat. No. 5,882,098, which is a continuation-in-part of application No. 08/754,887, Nov. 22, 1996, Pat. No. 5,769, 514.

[51] Int. Cl.[7] ..... A47B 43/00

[52] U.S. Cl. ..... 312/258; 312/258; 312/262; 312/196; 248/439; 248/165; 108/115

[58] Field of Search ..... 312/196, 108, 312/258, 262, 265.6; 108/50.01, 115, 162, 176, 179, 91, 92, 99; 248/439, 165, 434, 440

[56] References Cited

U.S. PATENT DOCUMENTS

| | | | |
|---|---|---|---|
| D. 357,599 | 4/1995 | Kelley | D6/439 |
| 680,206 | 8/1901 | La Mar | 312/262 |
| 795,844 | 8/1905 | March . | |
| 915,618 | 3/1909 | Mattison | 312/262 X |
| 1,237,009 | 8/1917 | Yaw . | |
| 1,568,167 | 1/1926 | Kunkle . | |
| 1,782,623 | 11/1930 | McCaslin | 108/131 |
| 2,409,495 | 10/1946 | Kelley | 108/115 X |
| 2,483,340 | 9/1949 | Gilbart | 312/258 |
| 2,542,770 | 2/1951 | Hall | 108/131 |
| 3,373,703 | 3/1968 | Barecki | 108/50.01 |
| 3,644,011 | 2/1972 | MacDonald | 312/258 |
| 3,854,828 | 12/1974 | Jones . | |
| 3,865,051 | 2/1975 | Johl et al. | 108/132 |
| 3,966,286 | 6/1976 | Groseclose | 312/258 |
| 4,063,330 | 12/1977 | Triplette . | |

(List continued on next page.)

FOREIGN PATENT DOCUMENTS

| | | | |
|---|---|---|---|
| 136191 | 2/1950 | Australia | 312/258 |
| 277942 | 9/1930 | Italy | 108/129 |
| 270985 | 5/1927 | United Kingdom | 108/132 |
| 1399532 | 7/1975 | United Kingdom | 16/389 |

*Primary Examiner*—Janet M. Wilkens
*Attorney, Agent, or Firm*—Cort Flint

[57] ABSTRACT

Foldable, ready to use office furniture suite components are disclosed which include a foldable, ready to use office hutch which may be supported on a base. The hutch has an erect configuration for use as a furniture component and a folded configuration for storage. The hutch includes a back panel included in the hutch, a first side panel pivotally attached to the back panel and a second side panel pivotally attached to the back panel. A horizontal panel is pivotally carried by the back panel and a vertical case panel is pivotally carried by one of the back panel for forming a utility case with one of the first and second side panels. Cabinet panels for forming a utility cabinet within the interior of the hutch include a vertical cabinet panel pivotally carried by one of the back panel and the horizontal panel, and a horizontal cabinet panel pivotally carried by the vertical cabinet panel. At least a first displaced pivot hinge attaches the first panel to the back panel having a pivot displaced a distance from the back panel; at least one second side panel displaced pivot hinge pivotally attaches the second side panel to the back panel having a pivot displaced from the back panel. The hutch has a folded configuration in which the first and second side panels are folded inwardly about the displaced pivots to overlie a portion of at least the horizontal panel and accommodate the horizontal panel, the vertical case panel, and the vertical and horizontal cabinet panels in the folded hutch configuration.

21 Claims, 9 Drawing Sheets

U.S. PATENT DOCUMENTS

| | | | |
|---|---|---|---|
| 4,099,809 | 7/1978 | Leotta | 312/258 X |
| 4,135,273 | 1/1979 | Holmes . | |
| 4,341,164 | 7/1982 | Johnson | 108/129 X |
| 4,582,003 | 4/1986 | Valero | 108/179 |
| 4,715,296 | 12/1987 | Wilkinson | 108/132 X |
| 4,731,029 | 3/1988 | Lerner et al. . | |
| 4,944,694 | 7/1990 | Dorn . | |
| 5,191,977 | 3/1993 | Markovitz | 211/40 X |
| 5,290,099 | 3/1994 | Lechman | 312/208.1 |
| 5,390,999 | 2/1995 | Fuller | 312/258 X |
| 5,403,082 | 4/1995 | Kramer | 312/249.9 |
| 5,457,600 | 10/1995 | Campbell et al. | 361/643 |
| 5,487,525 | 1/1996 | Drabczyk et al. | 108/143 X |
| 5,509,361 | 4/1996 | Chen | 108/131 X |
| 5,518,310 | 5/1996 | Ellman et al. | 312/223.6 X |
| 5,535,682 | 7/1996 | Aigeldinger | 108/129 X |
| 5,664,854 | 9/1997 | Letch | 312/262 |
| 5,694,862 | 12/1997 | Grubb | 108/50.11 |

PREASSEMBLED FOLDABLE OFFICE SUITE

This is a continuation-in-part of application Ser. No. 08/885,296 filed on Jun. 27, 1997, now U.S. Pat. No. 5,882,098, entitled PREASSEMBLED FOLDABLE PRINTER STAND which is a continuation-in-part of application Ser. No. 08/754,887 filed on Nov. 22,1996, now U.S. Pat. No. 5,769,514 issued on Jun. 23,1998, entitled READY TO USE FOLDABLE COMPUTER DESK.

BACKGROUND OF THE INVENTION

The invention relates to preassembled foldable office suite components which are ready to use and do not need any appreciable assembly for use. In particular, the invention relates to such office furniture which may be used to form a office suite wherein the furniture may be folded for shipment or storage, and which may be readily unfolded to a sturdy, erect configuration for use without need of appreciable assembly or further effort.

Heretofore, desks and stands for various office equipment and the like have been provided which are shipped unassembled and must be assembled by the purchaser. For example, unassembled computer desks are quite popular, however, the furniture requires much time and effort in its assembly. The assembly often produces frustration since the parts and their assembly are numerous. The furniture is not readily useable when purchased due to the time and effort required for assembly, nor may the furniture be readily taken apart or folded for storage when not in use.

U.S. Pat. No. 4,099,809 discloses a collapsible work station which is connected to a partition extension wall. The work station comprises a rear support wall having a plurality of shelves of varying sizes. The shelves are hinged to the back support wall to assume various positions with respect to the support wall. Two side support walls fold over the shelves in a storing position. While this device provides a collapsible configuration for a work station there may be attached to partition walls and the like, the construction is not suitable for a general purpose utility stand wherein a closed top is desired. U.S. Pat. No. 4,579,401 discloses a collapsible cabinet, U.S. Pat. No. 2,764,462 discloses a portable collapsible bar, and U.S. Pat. No. 835,902 discloses a knockdown wardrobe being of only general interest to the present invention.

Accordingly, an object of the present invention is to provide pre-assembled, foldable, ready to use office suite components which are readily folded for shipment or storage, and may be readily unfolded to a sturdy erect position for use.

Yet another object of the present invention is to provide various furniture components for an office suite wherein the components have a folded configuration wherein various panels of the furniture are folded about displaced pivots to provide a compact folded configuration.

Yet another object of the invention is to provide preassembled, foldable components which are ready to use with an office suite wherein the components have various utility cabinets and cases when unfolded and erected for use.

SUMMARY OF THE INVENTION

The above objectives are accomplished according to the present invention in an office furniture suite of the type comprising a desk, a rear credenza disposed generally parallel and behind the desk, and a hutch disposed atop the desk wherein ready to use office suite components are provided comprising a foldable, ready to use office hutch which may be supported on the desk, the hutch having an erect configuration for use as a furniture component and a folded configuration for storage. A back panel is included in the hutch; and a first and second side panel are pivotally attached to the back panel. There is a horizontal panel pivotally carried by the back panel. At least a first displaced pivot hinge attaches the first panel to the back panel having a pivot displaced a distance from the back panel. At least one second side panel displaced pivot hinge pivotally attaches the second side panel to the back panel having a pivot displaced from the back panel. A utility space is formed in an interior of the hutch in the erect configuration defined by at least one foldable panel. The hutch has a folded configuration in which the first and second side panels are folded inwardly about the displaced pivots to overlie a portion of the horizontal panel and accommodate the horizontal panel, and the at least one utility panel in the folded hutch configuration.

Advantageously, the utility spaced is defined by a vertical case panel pivotally carried by one of the back panel or horizontal panel for forming a vertical case with one of the first and second side panels. Preferably, the vertical case panel is pivotally carried by the back panel, and includes a lock for maintaining the vertical case panel fixed in relation to the horizontal panel. A utility case may be formed by the vertical case panel and a interior surface of the one side panel, and a CD rack may be carried in the utility case for holding a plurality of compact disks. The CD rack comprises a first rack part carried by the vertical case panel and a second rack part carried by the one side panel wherein the first and second rack parts form corresponding supports for receiving the compact disk. In addition, or alternately, a utility cabinet may define the utility space which includes a vertical cabinet panel pivotally carried by one of the back panel and the horizontal panel, and a horizontal cabinet panel pivotally carried by the vertical cabinet panel so that a cabinet interior is provided when the hutch is in the erect configuration. Shelf supports are carried in the cabinet interior when the hutch is in the erect configuration, and a plurality of shelf supports are formed within the utility cabinet for supporting one or more horizontal shelves in the utility cabinet. Preferably, the vertical cabinet panel is pivotally carried by the horizontal panel, and including a latch for securing the horizontal cabinet panel to an adjacent side panel.

A credenza may be provided having an erect configuration for use as a furniture component and a folded configuration for storage. The credenza comprises a table top, a first panel support leg pivotally carried by the table top, and a second panel support leg pivotally carried by the table top. At least one displaced pivot hinge pivotally attaches one of the first and second panel support legs to the table top so that first and second panel support legs may fold at least partially one inside the other when the credenza is in the folded configuration. A modesty panel is connected between the first and second support panel legs when the credenza is in the erect configuration; and a plurality of quick attachments affixing the modest panel to the support panel legs and table top in the erect configuration. A gap is defined between top edges of the first and second panel support legs and the table top so that the panel legs may be rotated outwardly slightly past true vertical for insertion of the modesty panel and thereafter rotated inwardly to abut the modest panel and affixation of the quick attachment for a tight fit.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
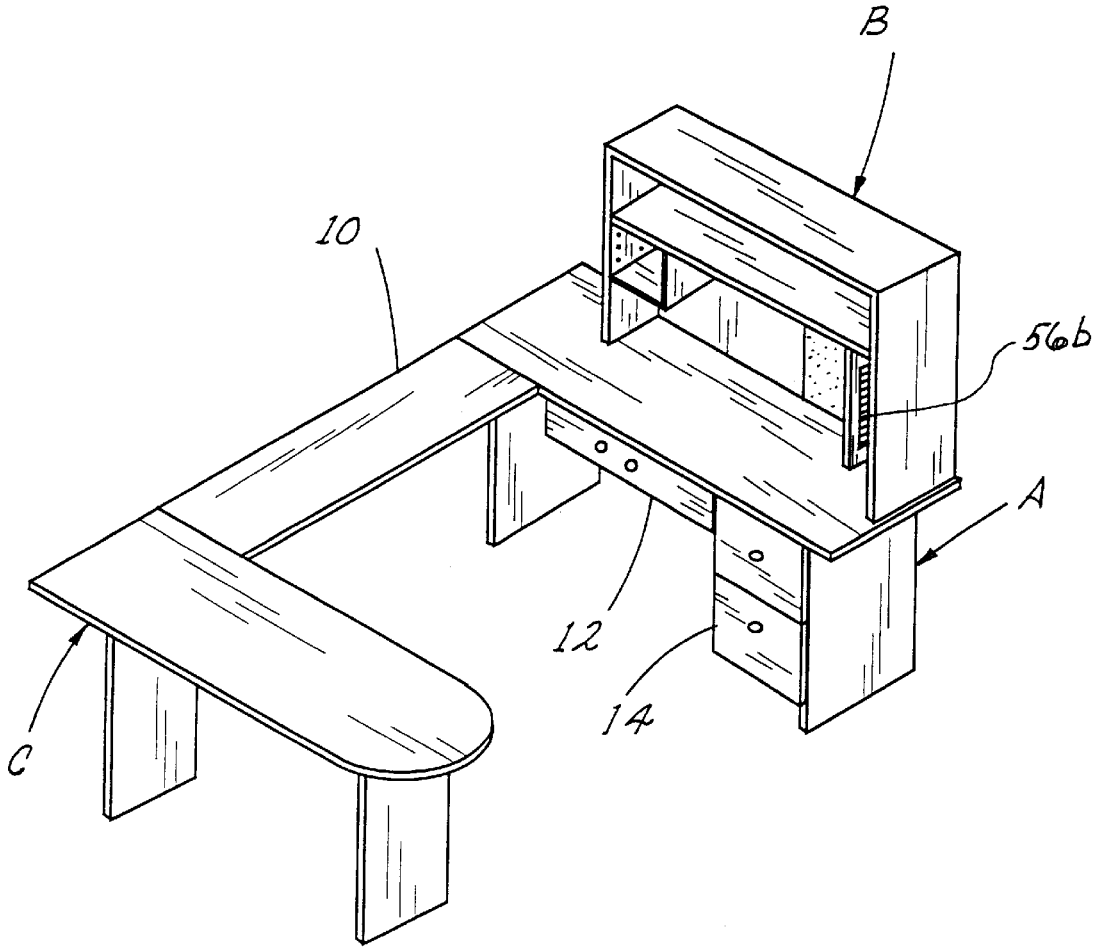
FIG. 1 is a prospective view illustrating an office suite having pre-assembled foldable, ready to use components.
Figure 7:
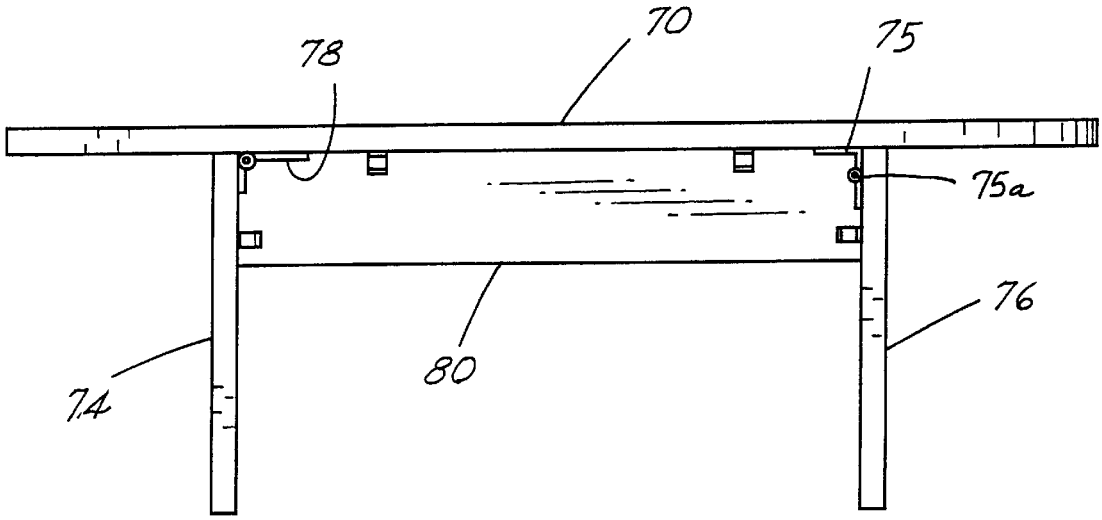
FIG. 7 is a front view of the credenza.

Referring now in more detail to the drawings, an office suite is illustrated in FIG. 1 which includes a desk, designated generally as A, a hutch designated generally as B, and a credenza, designated generally as C. In addition, a side return 10 may be utilized to bridge desk A and credenza C. While desk A is illustrated generally as a desk, it may have foldable features such as the utility desk disclosed in U.S. Pat. No. 5,769,514, incorporated herein by reference. In that case, a drawer 12 may be provided in the slidable keyboard drawer of the disclosed utility desk and the cabinet drawers 14 may be provided in the utility shelf illustrated in FIG. 7 of the disclosed foldable desk. The specific construction of desk A may be of any ready to use, foldable construction, and the specific features of the desk do not form a part of the present invention. Accordingly, only so much of desk A as is necessary to understanding the invention is described in detail.

Figure 2:
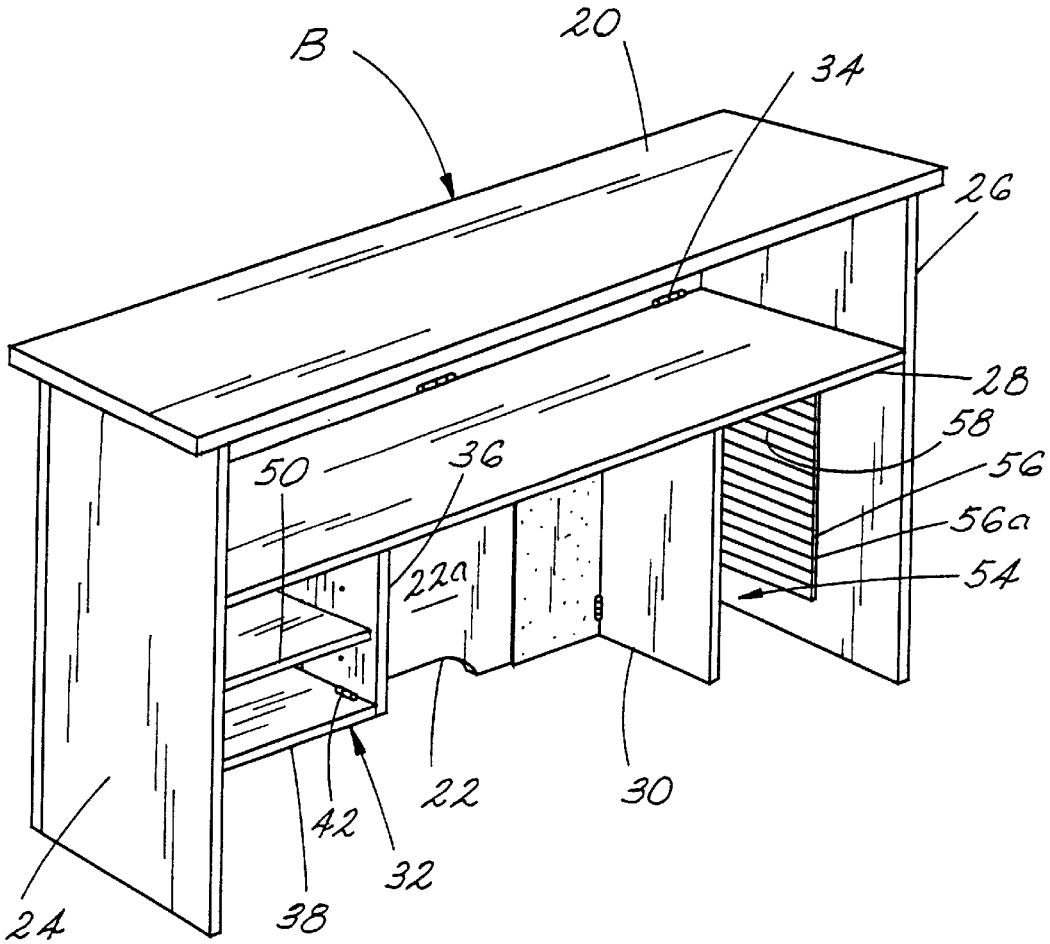
FIG. 2 is a prospective view of a ready to use foldable hutch for use in the office suite according to the invention.

As can best be seen in FIG. 2, hutch B which may be affixed atop desk A using any conventional means is illustrated. While the hutch is illustrated on top of desk A, it is to be understood, of course, that the hutch may be used on any type of base. Hutch B includes a removable, or foldable, top panel 20, a back panel 22, and first and second side panels 24, 26 defining a hutch exterior. The interior of hutch B includes a horizontal panel 28 which is foldable, a foldable vertical case panel 30, and a foldable utility cabinet 32.

Back panel 22 has a front surface 22*a* and a back surface 22*b*. Lower, horizontal panel 28 is pivotally attached to back panel 22 by means of conventional panel hinges 34 which are illustrated affixed to a bottom surface 28*b* of the horizontal panel and the front surface 22*a* of the back panel. Utility cabinet 32 includes a vertical cabinet panel 36 and a horizontal cabinet panel 38 which are hinged together. A first cabinet panel hinge 40 secures vertical cabinet panel 36 to bottom surface 28*b* of horizontal panel 28. Second cabinet panel hinges 42 pivotally attach the vertical and horizontal cabinet panels. Vertical case panel 30 is pivotally secured to front surface 22*a* of back panel 22 by means of conventional, case panel hinges 44. Other means and ways of foldably attaching the cabinet panels will be apparent to one skilled in the art having been taught the expedients of the present invention.

Figure 3:
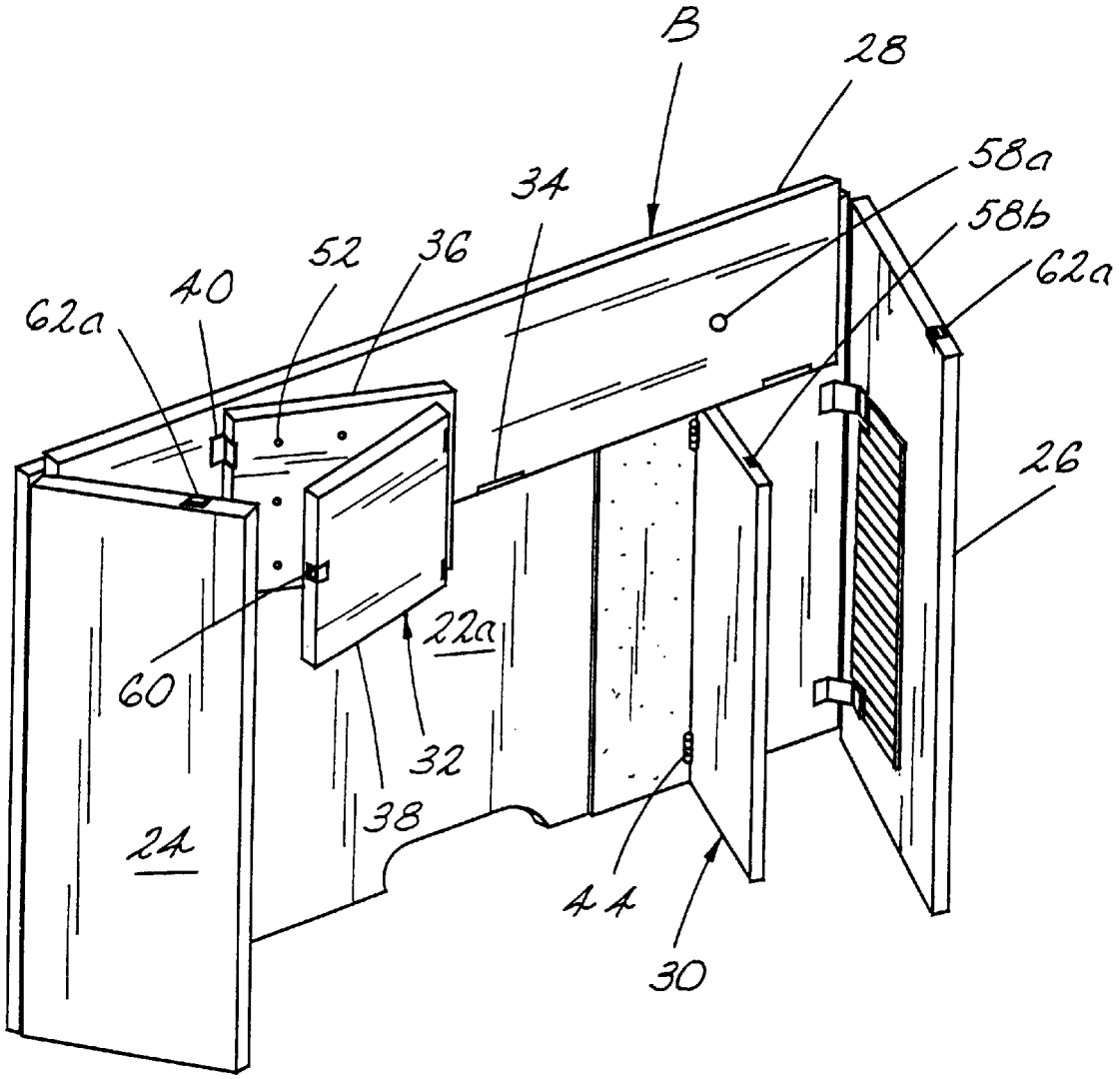
FIGS. 3 and 3A are prospective views with parts of the hutch in a folded or partially folded configuration.
Figure 3A:
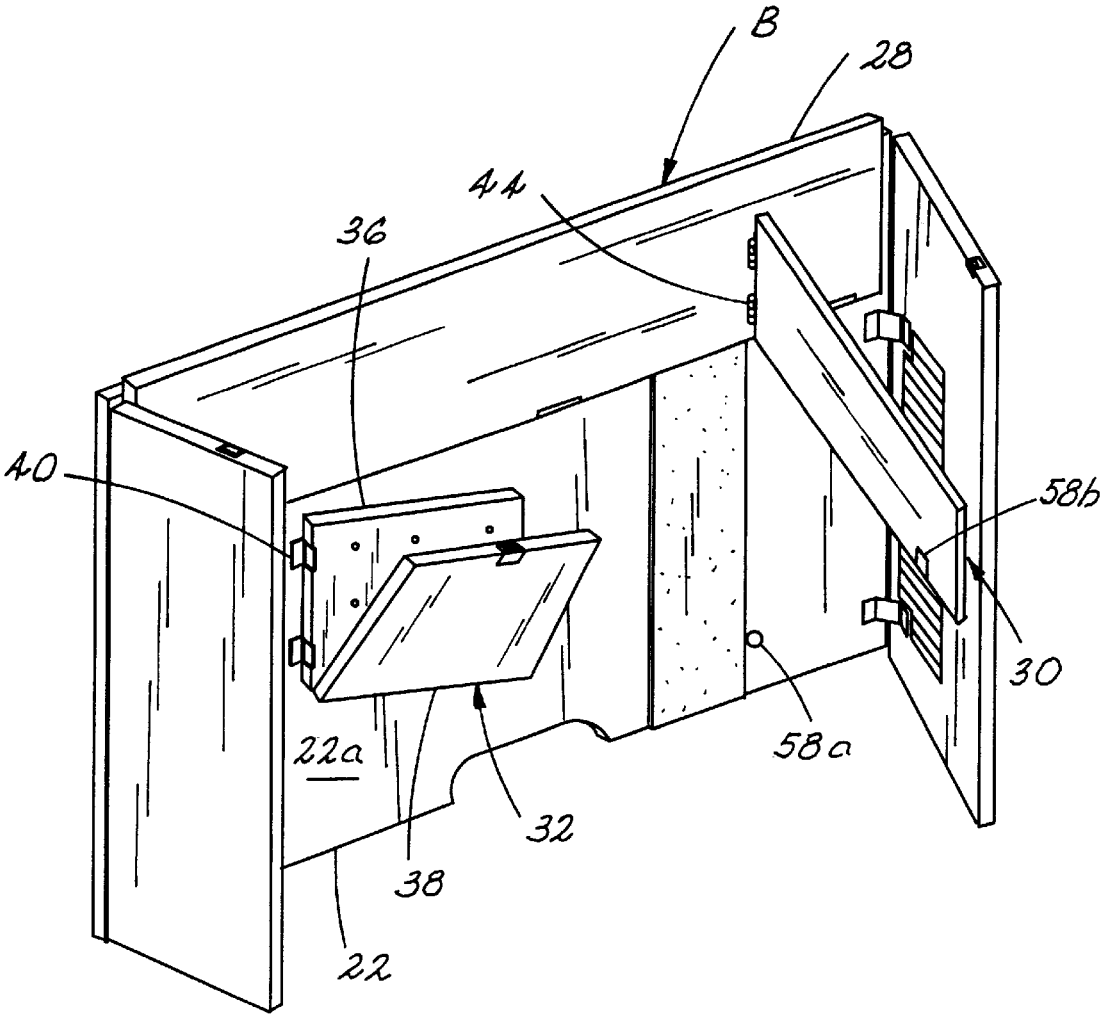
Figure 4:
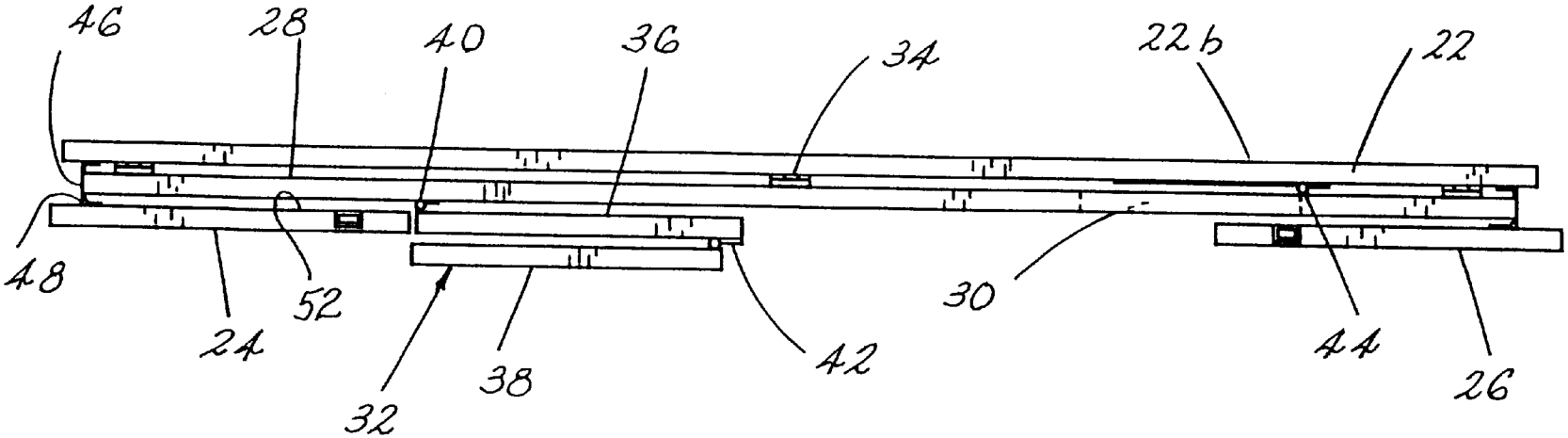
FIG. 4 is a top view of the hutch in a folded configuration.
Figure 5:
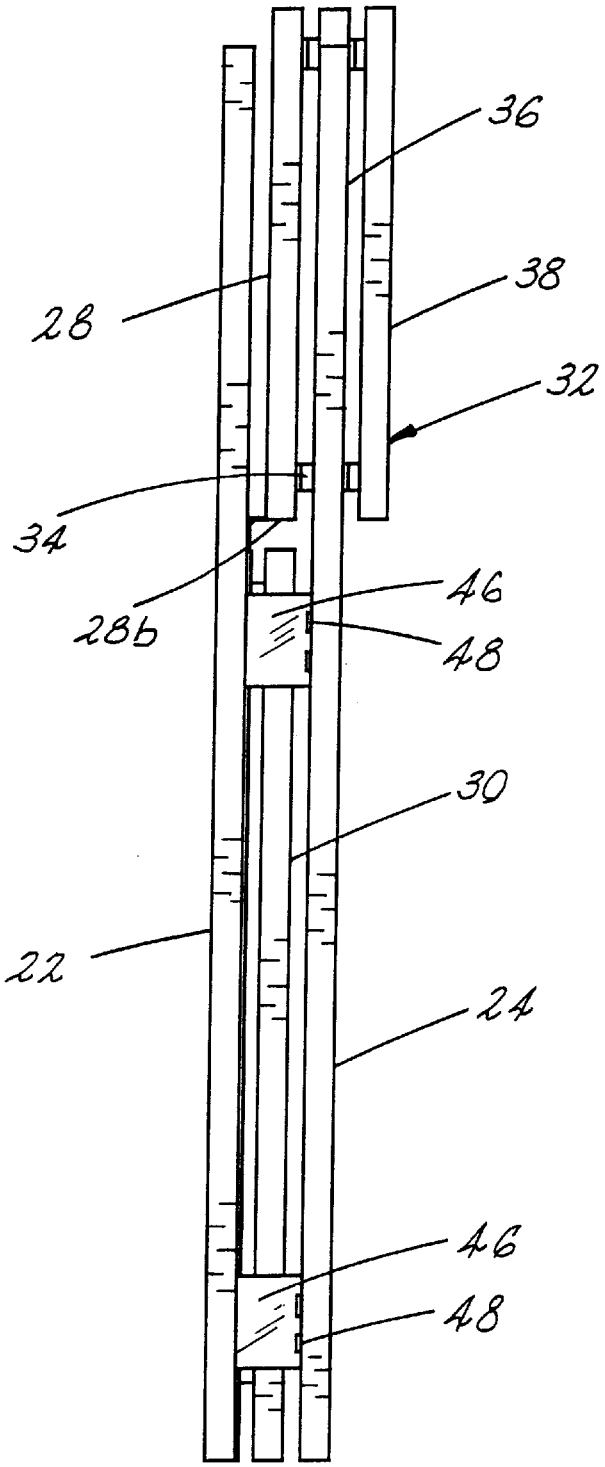
FIG. 5 is a side view of the hutch in a folded configuration.
Figure 6:
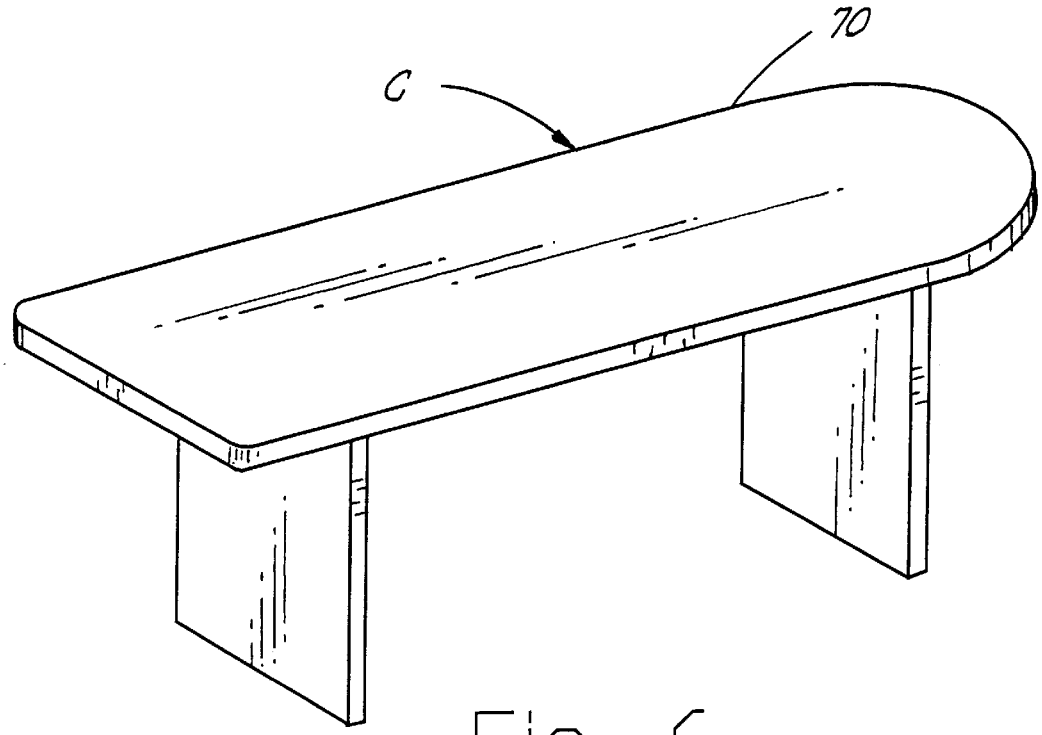
FIG. 6 is a prospective view of a preassembled, ready to use credenza for use in an office suite according to the invention.

First and second side panels 24, 26 are pivotally carried by back panel 22. There is at least a first side panel hinge 46 (FIG. 4) having a displaced pivot axis 48 carried by the back panel which pivotally attaches each side panel to the back panel. Preferably there are two such side panel hinges 46 which are spaced apart on each side of the back panel to secure the side panels. Each hinge has a displaced pivot axis 48 which is displaced a distance from front surface 22*a* of back panel 22 so that the side panels may fold about horizontal panel 28 when the hutch is in a folded configuration. As can best be seen in FIG. 2, when the hutch is unfolded and ready to use, utility cabinet 32 may be provided with shelves 50 which are supported by conventional shelf pins (not shown) received in support holes 52. In a conventional manner, a series of holes 52 may be provided so that the shelves may be adjusted in their position. Holes 52 are formed in vertical cabinet panel 36 and the opposing interior surface of side panel 24 (FIG. 3). In addition, vertical case panel 30 forms a vertical case, designated generally as 54. The case may be used for a variety of purposes. In the illustrated example, a rack 56 having a plurality of slots 56*a* is provided. Each slot 56 holds a compact disk (CD). CD rack 56 is provided by a first rack part 56*a* carried by the inside surface of side panel 26 and a second rack part (56*b*) carried on the inside surface of vertical case panel 30. Suitable CD rack parts are readily available in the market, for example, model no. 4304-LAL20 available from the J. G.Edelen Company of Baltimore, Maryland. It is also to be understood, of course, that the vertical cabinet panel 36 will be attached to front surface 22*a* of back panel 22 as well; and that vertical case panel 30 likewise may be hinged from the bottom surface of horizontal panel 28 as well, as can best be seen in FIG. 3A.

In use, when hutch B is in an unfolded, erect configuration as shown in FIG. 2, vertical side panel is locked in place by means of a lock having a first lock part 58*a* carried by bottom surface 28*b* of horizontal panel 28. A second lock part 58*b* which cooperates with first lock part 58*a* is carried on a top edge of vertical panel 30 to lock the vertical panel and horizontal panel together. Similarly, a cabinet latch 60 is carried by the free edge of horizontal cabinet panel 38 which mates with a corresponding latch element carried on inside surface of side panel 24 to lock the utility cabinet in its erect configuration. Top panel 20 may either be removable or foldable. In the illustrated embodiment, the top panel is removable and is affixed to the top of the hutch when the remaining panels are unfolded and erect by means of top panel latches having a first part 62*a* carried on top edges of first and second side panels 24, 26. Corresponding and mating latch elements are carried by the underneath surface of top 20. For example, cam locks 39*all* , 39*b* illustrated in FIG. 2 of co-pending application Ser. No. 08/885,296 now U.S. Pat. No. 5,882,098, identified above, may be used, the disclosure of said application being incorporated herein by reference.

Referring now to FIGS. 6 through 11, credenza C will now be described. Credenza C includes a peninsula table or D-table having a table top 70. A first panel support leg 74 is pivotally carried by table top 70 and a second panel support leg 76 is pivotally carried by the table top. One of the panel support legs is secured by means of a displaced pivot hinge 75 to the table top. In the illustrated embodiment, second panel support leg 76 is pivotally attached by the displaced pivot hinge having a displace pivot 75*a*. A panel hinge 78 secures first panel support leg 72. A modesty panel 80 is affixed between first and second panel support legs 74, 76 and table top 70, as can best be seen in FIG. 7.

Figure 8:
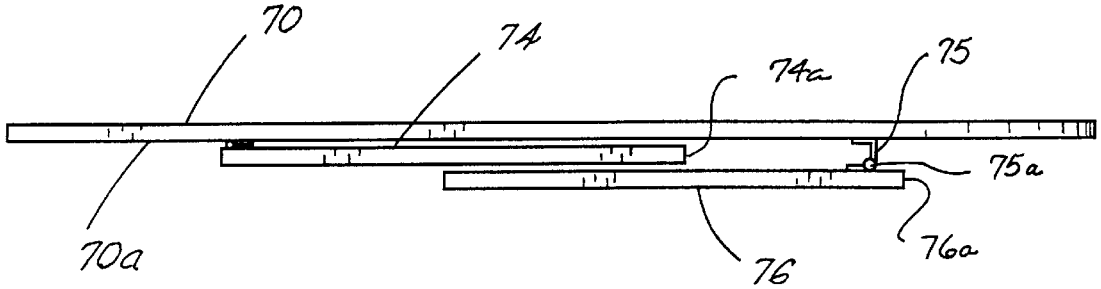
FIG. 8 is a top view of the credenza in a folded configuration.
Figure 9:
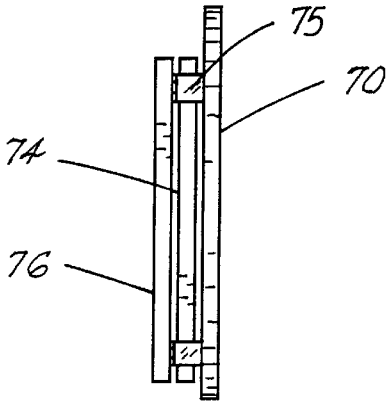
FIG. 9 is a side view of the credenza in a folded configuration.
Figure 10:
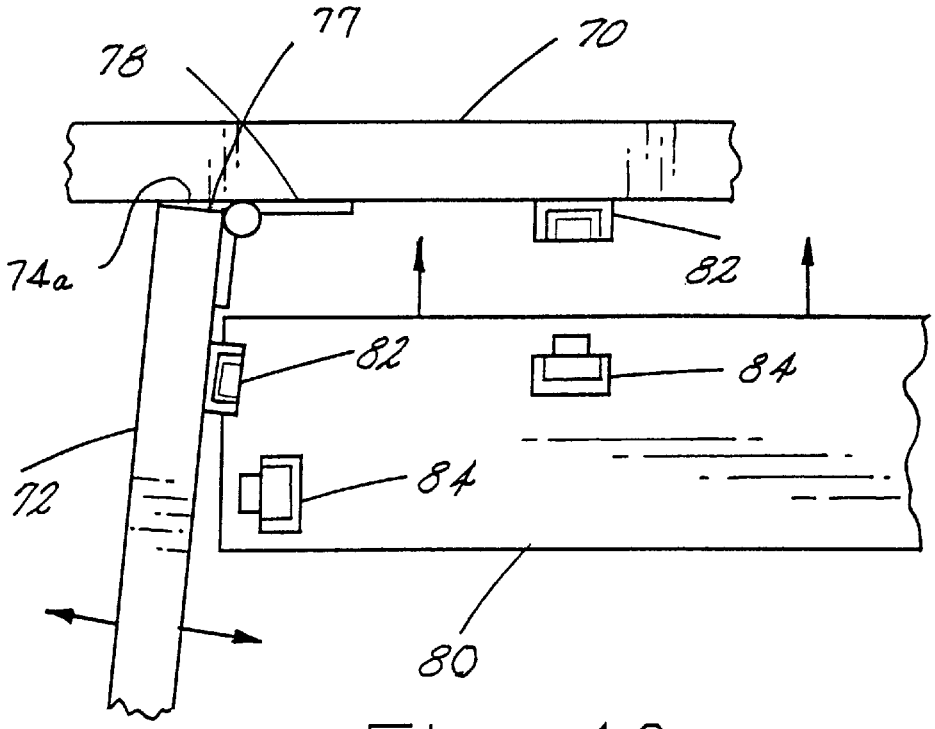
FIG. 10 is a partial elevation illustrating a removable modesty panel for a ready to use credenza according to the invention.
Figure 11:
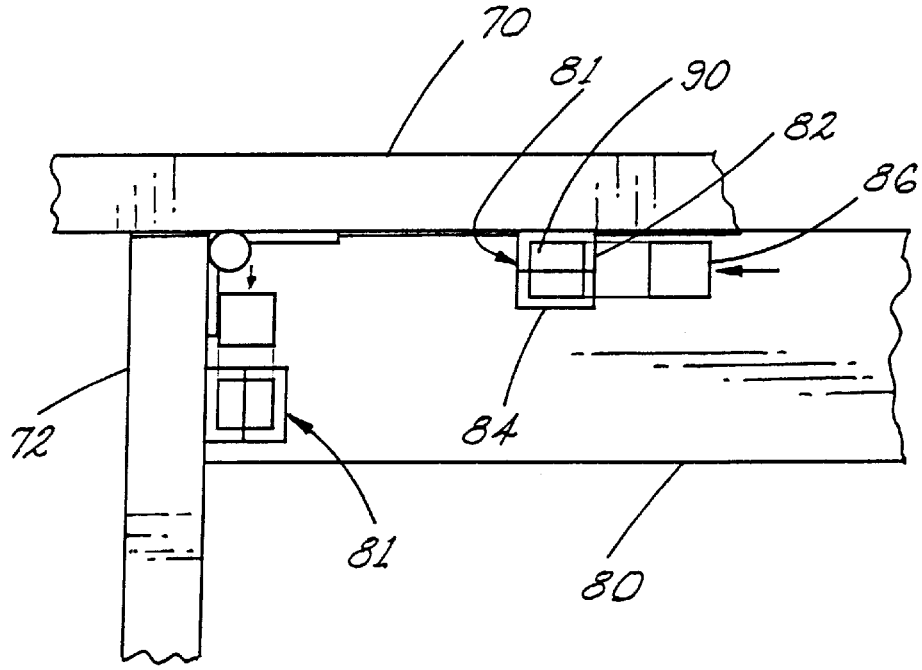
FIG. 11 is a partial elevation illustrating the modesty panel of FIG. 10 assembled in accordance with the present invention.

As can best be seen in FIGS. 8 and 9, credenza C has a folded configuration in which first panel support leg 74 is folded against an underneath surface of table top 70*a*, and second panel support leg 76 is folded inwardly to overlie first panel support leg 74. In the folded configuration modesty panel 80 is removed. The modesty panel is secured by quick attachment means 81 which includes a first attachment part 82 affixed to the table top 70, a second attachment part 84, and a joining element 86 which secures the two parts 82 and 84 together. A similar quick release attachment is secured between modesty panel 78 and each support panel leg, as illustrated. The joiner element 86 has clamp legs which fit over a block flange 90 having a half which is carried by each attachment part. In order to provide a rigid structural assembly, there is a slight gap 77 created between the top edges of support legs 74, 76 at 74*a* and 76*a* so that the support legs may be rotated outwardly slightly past center or true vertical (FIG. 10) for insertion of the modesty panel, and then rotated inwardly tightly against the modesty panel for securing of the quick attachment (FIG. 11). Suitable quick attachment hardware is available from J. G. Edelen Company of Baltimore, Maryland, as "quick fast connector" model no. 270E.

While a preferred embodiment of the invention has been described using specific terms, such description is for illustrative purposes only, and it is to be understood that changes and variations may be made without departing from the spirit or scope of the following claims.

What is claimed is:

1. A foldable, ready to use office furniture suite component comprising;

a foldable, ready to use office hutch which may be supported on a base, said hutch having an erect configuration for use as a furniture component and a folded configuration for storage;

a back panel included in said hutch;

a first side panel pivotally attached to said back panel;

a second side panel pivotally attached to said back panel;

a horizontal panel pivotally carried by said back panel;

a vertical case panel pivotally carried by one of said back panel or horizontal panel for forming a vertical case with one of said first and second side panels;

means for forming a utility cabinet within the interior of said hutch including a vertical cabinet panel pivotally carried by one of said back panel and said horizontal panel, and a horizontal cabinet panel pivotally carried by said vertical cabinet panel;

at least a first displaced pivot hinge attaching said first panel to said back panel having a pivot displaced a distance from said back panel;

at least one second side panel displaced pivot hinge pivotally attaching said second side panel to said back panel having a pivot displaced from said back panel; and said first and second side panels of said hutch being folded inwardly about said displaced pivots to overlie a portion of at least said horizontal panel and accommodate said horizontal panel, said vertical case panel, and said vertical and horizontal cabinet panels in said folded configuration.

2. The component of claim 1 wherein said vertical case panel is pivotally carried by said back panel, and including a lock for maintaining said vertical case panel fixed in relation to said horizontal panel.

3. The component of claim 2 comprising a utility case formed by said vertical case panel and an interior surface of one of said first and second side panels, and a CD rack carried in said utility case for holding a plurality of compact disks.

4. The component of claim 3 wherein said CD rack comprises a first rack part carried by said vertical case panel and a second rack part carried by said one side panel, said first and second rack parts forming corresponding supports for receiving said compact disks.

5. The component of claim 1 wherein said vertical and horizontal cabinet panels form a utility cabinet when said hutch is in said erect configuration, and a plurality of shelf supports formed within said utility cabinet for supporting one or more horizontal shelves in said utility cabinet.

6. The component of claim 1 wherein said vertical cabinet panel is pivotally carried by said horizontal panel, and including a latch for securing said horizontal cabinet panel to an adjacent side panel in said erect configuration.

7. The component of claim 6 wherein said vertical and horizontal cabinet panels form a utility cabinet when said hutch is in said erect configuration, and a plurality of shelf supports formed within said utility cabinet for supporting one or more horizontal shelves in said utility cabinet.

8. In an office furniture suite of the type comprising a desk, a rear credenza disposed generally parallel and behind the desk, and a hutch being disposed atop the desk, ready to use office suite components wherein said hutch comprises;

a foldable, ready to use office hutch which may be supported on said desk, said hutch having an erect configuration for use as a furniture component and a folded configuration for storage;

a back panel included in said hutch;

a first side panel pivotally attached to said back panel;

a second side panel pivotally attached to said back panel;

a horizontal panel pivotally carried by said back panel;

at least a first displaced pivot hinge attaching said first panel to said back panel having a pivot displaced a distance from said back panel;

at least one second side panel displaced pivot hinge pivotally attaching said second side panel to said back panel having a pivot displaced from said back panel;

a utility space formed in an interior of said hutch in said erect configuration defined by at least one foldable panel;

said first and second side panels of said hutch being folded inwardly about said displaced pivots to overlie a portion of said horizontal panel and accommodate said horizontal panel, and said at least one foldable panel in said folded hutch configuration;

said credenza having an erect configuration for use as a furniture component and a folded configuration for storage, and wherein said credenza comprises:

a table top;

a first panel support leg pivotally carried by said table top;

a second panel support leg pivotally carried by said table top;

at least one displaced pivot hinge pivotally attaching one of said first and second panel support legs to said table top;

so that first and second panel support legs may fold at least partially one inside the other when said credenza is in said folded configuration;

a modesty panel connected between said first and second support panel legs when said credenza is in said erect configuration;

a plurality of quick attachments affixing said modest panel to said support panel legs and table top in said erect configuration; and a gap defined between top edges of said first and second panel support legs and said table top so that said panel legs may be rotated inwardly to abut said modest panel allowing affixation of said quick attachments.

9. The suite of claim 8 wherein said utility space is defined by a vertical case panel pivotally carried by one of said back panel or horizontal panel for forming a vertical case with one of said first and second side panels.

10. The suite of claim 9 wherein said vertical case panel is pivotally carried by said back panel, and including a lock for maintaining said vertical case panel fixed in relation to said horizontal panel.

11. The suite of claim 10 comprising a utility case formed by said vertical case panel and an interior surface of one of said first and second side panels; and a CD rack carried in said utility case for holding a plurality of compact disks.

12. The suite of claim 11 wherein said CD rack comprises a first rack part carried by said vertical case panel and a second rack part carried by said one side panel, said first and second rack parts forming corresponding supports for receiving said compact disks.

13. The suite of claim 8 including a utility cabinet defining said utility space which includes a vertical cabinet panel pivotally carried by one of said back panel and said horizontal panel, and a horizontal cabinet panel pivotally carried by said vertical cabinet panel so that a cabinet interior is provided when said hutch is in said erect configuration.

14. The suite of claim 13 including a plurality of shelf supports carried in said cabinet interior when said hutch is in said erect configuration for supporting one or more horizontal shelves in said utility cabinet.

15. The suite of claim 13 wherein said vertical cabinet panel is pivotally carried by said horizontal panel, and including a latch for securing said horizontal cabinet panel to an adjacent side panel.

16. An office furniture suite of the type comprising a desk, a hutch carried on said desk, and a credenza carried in functional relationship to said desk and hutch comprising:

said hutch including a foldable, ready to use office hutch which may be supported on said desk, said hutch having an erect configuration for use as a furniture component and a folded configuration for storage;

a back panel included in said hutch;

a first side panel pivotally attached to said back panel;

a second side panel pivotally attached to said back panel;

a horizontal panel pivotally carried by said back panel;

a vertical case panel pivotally carried by one of said back panel or horizontal panel for forming a vertical case with one of said first and second side panels;

means for forming a utility cabinet within the interior of said hutch including a vertical cabinet panel pivotally carried by one of said back panel and said horizontal panel, and a horizontal cabinet panel pivotally carried by said vertical cabinet panel;

at least a first displaced pivot hinge attaching said first panel to said back panel having a pivot displaced a distance from said back panel;

at least one second side panel displaced pivot hinge pivotally attaching said second side panel to said back panel having a pivot displaced from said back panel;

said hutch having a folded configuration in which said first and second side panels are folded inwardly about said displaced pivots to overlie a portion of at least said horizontal panel and accommodate said horizontal panel, said vertical case panel, and said vertical and horizontal cabinet panels in said folded hutch configuration;

said credenza having an erect configuration for use as a furniture component and a folded configuration for storage, and wherein said credenza comprises:

a table top;

a first panel support leg pivotally carried by said table top;

a second panel support leg pivotally carried by said table top;

at least one displaced pivot hinge pivotally attaching each of said first and second panel support legs to said table top; and so that first and second panel support legs may fold at least partially one inside the other when said credenza is in said folded configuration.

17. The suite of claim 16 comprising:

a modesty panel connected between said first and second support panel legs when said credenza is in said erect configuration; and a plurality of quick attachments affixing said modesty panel to said support panel legs and affixing said modesty panel to said table top in said erect configuration.

18. The suite of claim 17 including a gap defined between top edges of said first and second panel support legs and said table top so that said panel legs may be rotated outwardly slightly past true vertical for insertion of said modesty panel and thereafter rotated inwardly to abut said modest panel allowing affixation of said quick attachments.

19. The suite of claim 16 wherein said vertical case panel is pivotally carried by said back panel, and including a lock for maintaining said vertical case panel fixed in relation to said horizontal panel.

20. The suite of claim 19 comprising a utility case formed by said vertical case panel and an interior surface of one of said first and second side panels, and a CD rack carried in said utility case for holding a plurality of compact disks.

21. The suite of claim 16 wherein said vertical and horizontal cabinet panels form a utility cabinet when said hutch is in said erect configuration, and a plurality of shelf supports formed within said utility cabinet for supporting one or more horizontal shelves in said utility cabinet.

* * * * *